US007379686B2

(12) United States Patent
Nishikawa

(10) Patent No.: US 7,379,686 B2
(45) Date of Patent: May 27, 2008

(54) IMAGE FORMING APPARATUS FEATURING FIRST AND SECOND DEVELOPER AGENT REMOVING MEMBERS

(75) Inventor: Akihiro Nishikawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 11/466,888

(22) Filed: Aug. 24, 2006

(65) Prior Publication Data

US 2007/0059028 A1 Mar. 15, 2007

(30) Foreign Application Priority Data

Sep. 9, 2005 (JP) ..... 2005-262542

(51) Int. Cl.
*G03G 15/16* (2006.01)
*G03G 21/00* (2006.01)

(52) U.S. Cl. ..... 399/101; 399/71; 399/349

(58) Field of Classification Search ..... 399/101, 399/349, 71, 302, 308, 343, 345, 297
See application file for complete search history.

(56) References Cited

U.S. PATENT DOCUMENTS

| | | | | |
|---|---|---|---|---|
| 5,031,000 | A * | 7/1991 | Pozniakas et al. | 399/349 |
| 5,107,303 | A * | 4/1992 | Miyamoto et al. | 399/349 |
| 5,991,566 | A * | 11/1999 | Tanaka et al. | 399/101 |
| 7,190,919 | B2 * | 3/2007 | Kitagawa | 399/101 |
| 2006/0083539 | A1 | 4/2006 | Nishikawa | 399/101 |
| 2006/0210300 | A1 | 9/2006 | Nishikawa | 399/101 |

FOREIGN PATENT DOCUMENTS

| | | | |
|---|---|---|---|
| JP | 5-80676 | A2 | 4/1993 |
| JP | 10-149033 | A2 | 6/1998 |
| JP | 2002-091181 | A * | 3/2002 |
| JP | 2002-207403 | A2 | 7/2002 |
| JP | 2004-93999 | A2 | 3/2004 |
| JP | 3591417 | B | 9/2004 |
| JP | 2006-011221 | A * | 1/2006 |

* cited by examiner

*Primary Examiner*—Sophia S Chen
(74) *Attorney, Agent, or Firm*—Fitzpatrick, Cella, Harper & Scinto

(57) ABSTRACT

An image forming apparatus including an image bearing member which bears developing-agent images; a first removing member which removes a developing agent from the image bearing member, wherein the first removing member is contacted with the image bearing member while a bias is applied to the first removing member; a second removing member which removes the developing agent from the image bearing member, wherein the second removing member is contacted with a region of the image bearing member from which the developing agent has been removed by the first removing member; and a member which releases the second removing member from the image bearing member in such a manner as to prevent the region of the image bearing member which is contacted with the first removing member at the time of interruption of the application of the bias to the first removing member from coming into contact with the second removing member.

4 Claims, 9 Drawing Sheets

IMAGE FORMING APPARATUS FEATURING FIRST AND SECOND DEVELOPER AGENT REMOVING MEMBERS

BACKGROUND OF THE INVENTION

1. Field of the Invention

The present invention relates to an electrophotographic type image forming apparatus such as a copying machine and a printer and, more particularly, to removing members for removing developing agents on an image bearing member.

2. Description of the Related Art

In recent years, in view of improvement of the quality of printed images, there has been a need for stabilization of the ability of cleaning members to remove developing agents from image bearing members.

Therefore, there have been used electrostatic cleaning members which capture and remove developing agents by being biased, as described in Japanese Patent Application Laid-open No. 2002-207403. Such electrostatic cleaning members are less prone to degrade their removing abilities due to wear of the cleaning members themselves and thus have stable removing abilities. In this case, some developing agents on the image bearing member bear smaller amount of electrical charges. Such developing agents are difficult to sufficiently remove with electrostatic cleaning members. Therefore, in order to compensate the removing ability of such electrostatic cleaning members, a contact-type cleaning member for removing developing agents from the image bearing member by contacting therewith is provided downstream side of the electrostatic cleaning members in the direction of the rotation of the image bearing member.

However, if the biases applied to the electrostatic cleaning members are interrupted, the developing agents captured by the electrostatic cleaning members will lose the constraint forces. Consequently, the developing agents captured by the electrostatic cleaning members will be adhered to the image bearing member, again. The developing agents moved from the electrostatic cleaning members to the image bearing member will be captured by the contact-type cleaning means and, at this time, the amount of the developing agents will be excessive for the contact-type cleaning member. This will cause the contact-type cleaning member to rub the developing agents on the image bearing member, contrary to the inherent effect of the contact-type cleaning member. It is difficult to properly form images on the regions having developing agents rubbed thereon, which may cause image failures.

SUMMARY OF THE INVENTION

It is an object of the present invention to prevent the occurrence of image failures due to developing agents rubbed on an image bearing member by a contact-type cleaning member.

It is another object to provide an image forming apparatus including: an image bearing member which bears developing-agent images;

a first removing member which removes a developing agent from the image bearing member, wherein the first removing member is contacted with the image bearing member while a bias is applied to the first removing member;

a second removing member which removes the developing agent from the image bearing member, wherein the second removing member is contacted with the region of the image bearing member from which the developing agent has been removed by the first removing means; and means which releases the second removing member from the image bearing member in such a manner as to prevent the region of the image bearing member which is contacted with the first removing member at the time of interruption of the application of the bias to the first removing member from coming into contact with the second removing member.

DETAILED DESCRIPTION OF THE PREFERRED EMBODIMENTS

The present invention can prevent the region of an image bearing member which has been contacted with electrostatic cleaning members at the time of interruption of the application of biases to the electrostatic cleaning members (the first removing members) from coming into contact with a contact-type cleaning member (a second removing member), thereby preventing the occurrence of image failures.

Hereinafter, examples of the present invention will be described in detail.

Next, with reference to the drawings, there will be described an image forming apparatus according to an embodiment of the present invention.

First Embodiment

Figure 1:
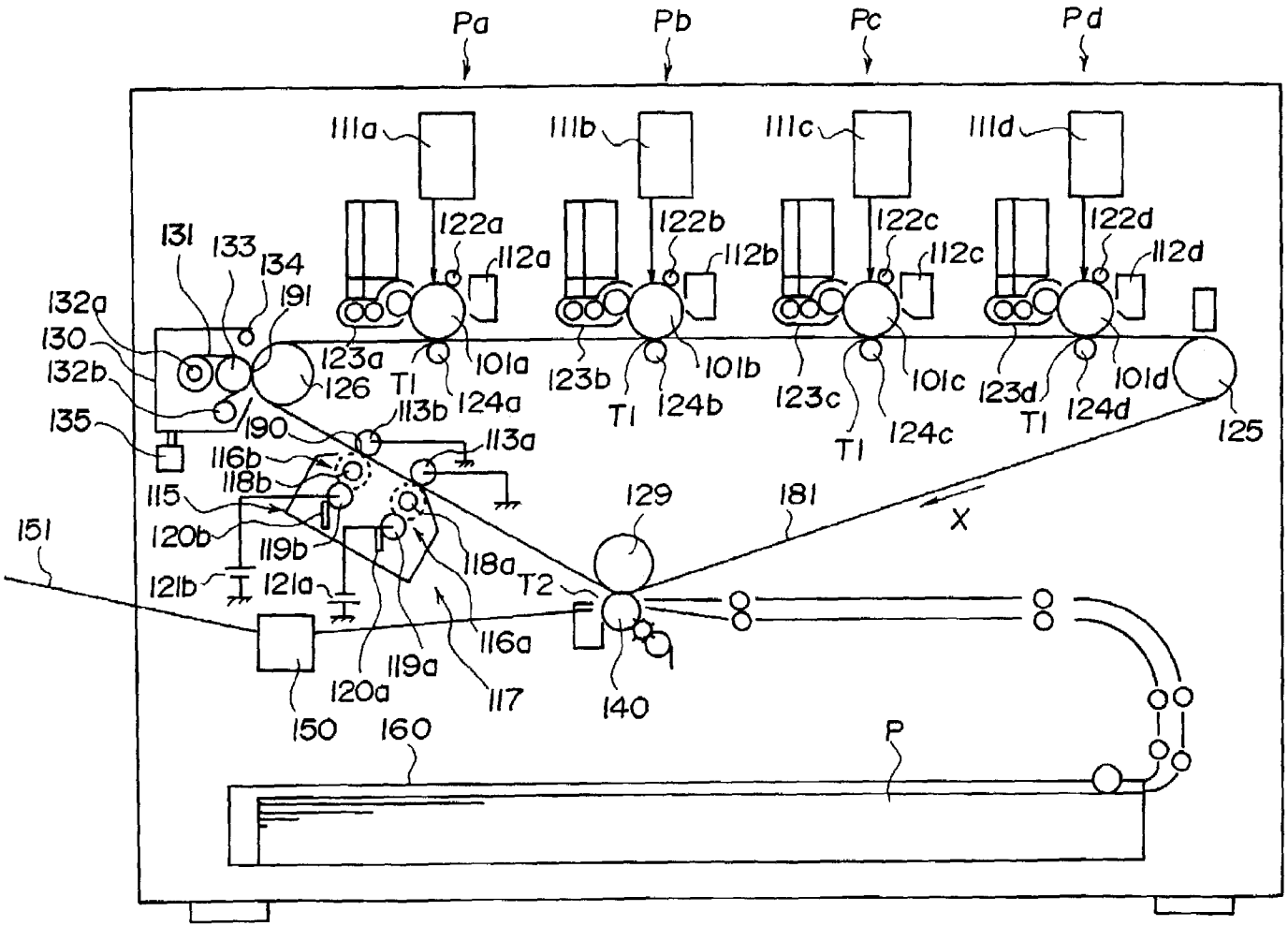
FIG. 1 is a cross-sectional explanation view of an image forming apparatus.
Figure 2:
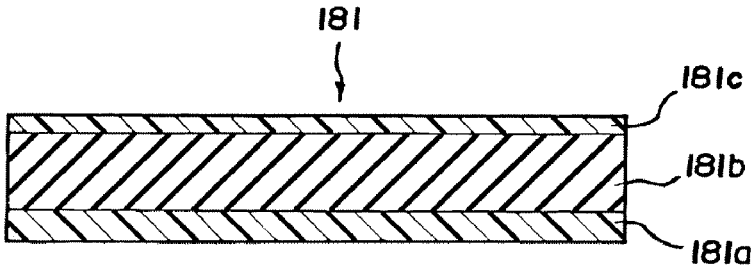
FIG. 2 is a cross-sectional explanation view of an intermediate transfer belt.

With reference to FIGS. 1 to 3, there will be described an image forming apparatus according to a first embodiment.

(The Entire Structure of the Image Forming Apparatus)

First, the entire structure of the image forming apparatus will be described. As illustrated in FIG. 1, the image forming apparatus according to the present embodiment is a tandem-type image forming apparatus including four image formation devices Pa, Pb, Pc and Pd arranged along an intermediate transfer belt (image bearing member) 181 which is an intermediate transfer member to be adapted to rotate in the direction of an arrow X. Namely, the four image formation devices Pa, Pb, Pc and Pd form toner images of yellow (Y), magenta (M), cyan (C), black (K), respectively, through electrophotography, and also primarily transfer the toner images to the intermediate transfer belt 181 by superimposing them thereon. Further, the toner images are collectively secondarily transferred to a sheet as a recording medium being transferred thereto to complete the image formation.

The respective image formation devices Pa, Pb, Pc and Pd are arranged such that the yellow image formation device Pa, the magenta image formation device Pb, the cyan image formation device Pc and the black image formation device Pd are arranged in the mentioned order from upstream side to downstream side in the direction of the rotation of the intermediate transfer belt 181. These image formation devices have the same structure, except that the color of toner images to be formed.

In the respective image formation devices Pa, Pb, Pc and Pd, processing means are placed around drum-shaped electrophotographic photosensitive members (hereinafter, referred to as "photosensitive drums") 101*a*, 101*b*, 101*c* and 101 *d*, which are image bearing members rotatably placed. Namely, there are placed electrification rollers 122*a*, 122*b*, 122*c* and 122*d*, exposing means 111*a*, 111*b*, 111*c* and 111*d*, developing means 123*a*, 123*b*, 123*c* and 123*d*, and drum cleaning means 112*a*, 112*b*, 112*c* and 112*d*. Further, primary transfer rollers 124*a*, 124*b*, 124*c* and 124*d* as primary transfer means are provided, at the positions where the respective image bearing members are in contact with the intermediate transfer belt 181.

Now, there will be described the image forming operation by exemplifying the yellow image formation device Pa. A bias is applied to the electrification roller 122*a* to uniformly electrify the surface of the photosensitive drum 101*a* being rotated, and light is directed thereto from the exposing means 111*a*, according to image signals, to form an electrostatic latent image. The latent image is developed with a yellow toner by the developing means 123*a* to form a visible image. The toner is electrified to have the negative polarity by developing means 123*a*. Further, a bias with the polarity opposite to that of the toner image (positive polarity) is applied to the primary transfer roller 124*a* to primarily transfer the toner image to the intermediate transfer belt 181, at the primary transfer portion T1 where the photosensitive drum 101*a* is in contact with the intermediate transfer belt 181. After the transferring of the toner image, the drum cleaning means 112*a* removes residual toner on the photosensitive drum 101*a*.

The other image formation devices Pb, Pc and Pd similarly perform the aforementioned transferring of toner images to perform transferring and formation of a full-color toner image. Further, the intermediate transfer belt 181 is wound around a driving roller 125, a tension roller 126 and a backup roller 129, which are supporting members, and is rotated at a predetermined speed in the direction of the arrow X during image formation.

On the other hand, in synchronization with the aforementioned image formation, a sheet P fed from a sheet cassette 160 mounted at a lower portion of the apparatus is conveyed to a secondary transfer portion T2 which is the portion where the intermediate transfer belt 181 is in contact with a secondary transfer roller 140 which is a secondary transfer means. Then, a bias with the polarity opposite to that of the toner image (positive polarity) is applied to the secondary transfer roller 140 to transfer the toner image on the intermediate transfer belt 181 to the conveyed sheet P. Further, the sheet P is conveyed to a fixing means 150 which fixes the toner thereto and then is discharged to a discharge tray 151.

Further, intermediate-transfer-member cleaning means 115 and 130 remove toner (secondary transfer residual toner) which has not transferred from the intermediate transfer belt 181 to the sheet P at the secondary transfer portion T2.

(Intermediate Transfer Belt)

The intermediate transfer belt 181 is an endless belt which is configured to run in the direction of the arrow X at a predetermined speed during image formation.

Further, the intermediate transfer belt 181 according to the present embodiment is configured to be an elastic belt having elasticity at its surface portion. More specifically, as illustrated in FIG. 2, the intermediate transfer belt 181 is an elastic belt having a three-layer configuration constituted by a resin layer 181*a*, an elastic layer 181*b* and a surface layer 181*c*.

The resin material constituting the resin layer 181*a* may be, for example, polycarbonate, fluororesin (ETFE, PVDF), polystyrene or the like. The elastic material (elastic rubber, elastomer) constituting the elastic layer 181*b* may be butyl rubber, fluoro rubber, acrylic rubber or the like. There is no limitation on the material of the surface layer 181*c*, but the material is required to reduce in adhesion force of toner to the surface of the intermediate transfer belt 181 for enhancing the secondary transferability. For example, the material of the surface layer 181*c* may be a resin material such as a polyurethane resin, a polyester resin, and an epoxy resin. However, it is not limited to these materials.

The intermediate transfer belt 181 having the elastic layer 181*b* at its surface portion as described above enables formation of high-quality images without dropout of figures, increase of the transfer efficiency, reduction of the amount of transfer residual toner and increase of the transferability to thick sheets and rough paper.

(Intermediate-Transfer-Belt Cleaning Device)

Next, there will be described the structure for cleaning off adherents residual on the intermediate transfer belt 181 after the secondary transfer, such as transfer residual toners.

The belt cleaning device according to the present embodiment includes a first cleaning device 115 and a second cleaning device 130. These devices are placed downstream side of the aforementioned secondary transfer portion T2, but upstream side of the primary transfer portion T1 of the yellow image formation device Pa, in the conveyance direction of the intermediate transfer belt 181.

The first cleaning device 115 is an adsorption-type cleaning means which applies, to cleaning members, a bias with the polarity opposite to that of the residual toner on the intermediate transfer belt for causing the cleaning members to adsorb to and remove the toner. In the present embodiment, electrically-conductive fur brushes are employed as the cleaning members, the fur brushes are rotated, and a bias is applied to the fur brushes for performing cleaning.

The second cleaning device 130 is a contact-type cleaning device which brings a cleaning member into contact with the intermediate transfer belt 181 and causes it to slide against the intermediate transfer belt 181 for removing residual toner on the belt or foreign materials thereon such as addition agents. In the present embodiment, a web member is employed as the cleaning member for wiping out toner. The second cleaning device is placed downstream side (hereinafter, referred to as "the downstream side") of the aforementioned first cleaning device in the direction of the rotation of the intermediate transfer belt 181, in order to remove toner and adherents on the belt which have been passed through the first cleaning device 115.

Further, in the present example, electrostatic cleaning members (first removing members) 118*a* and 118*b*, which are the cleaning members of the first cleaning device 115, are kept in contact with the intermediate transfer belt 181. However, in order to prevent the deformation of the electrostatic cleaning members 118*a* and 118*b* which are fur brushes, they may be made contactable with and removable from the intermediate transfer belt 181. In this case, the position at which the first toner cleaning device cleans off secondary-transfer residual toner on the intermediate transfer belt 181 is referred to as a first cleaning position. The position at which the second toner cleaning device cleans off secondary-transfer residual toner on the intermediate transfer belt 181 is referred to as a second cleaning position.

The first cleaning device 115 cleans off secondary-transfer residual toner on the intermediate transfer belt 181, in the following manner. That is, during the time interval starting with the passage of the leading edge of the region of the intermediate transfer belt 181 on which the toner image is formed, reaching to the first cleaning position, and ending with the passage of the trailing edge of the region through the first cleaning position, the electrostatic cleaning members 118*a* and 118*b* are kept in contact with the intermediate transfer belt 181 and a bias is applied to the electrostatic cleaning members 118*a* and 118*b*.

The second cleaning device further cleans the region of the intermediate transfer belt 181 which has been cleaned by the first cleaning device 115.

In the present example, a contact-type cleaning member 131 (a second removing member), which is the cleaning member of the second cleaning device 130, is made contactable with and removable from the intermediate transfer belt 181.

The second cleaning device 130 performs cleaning, in the following manner. That is, during the time interval starting with the passage of the leading edge of the region of the intermediate transfer belt 181 which has been cleaned by the first cleaning means, reaching to the second cleaning position, and ending with the passage of the trailing edge of the region through the second cleaning position, the contact-type cleaning member 131 of the second cleaning device is kept in contact with the intermediate transfer belt 181.

Next, there will be described, in detail, the structures of the first cleaning device 115 and the second cleaning device 130 according to the present embodiment.

(First Cleaning Device)

Figure 3A:
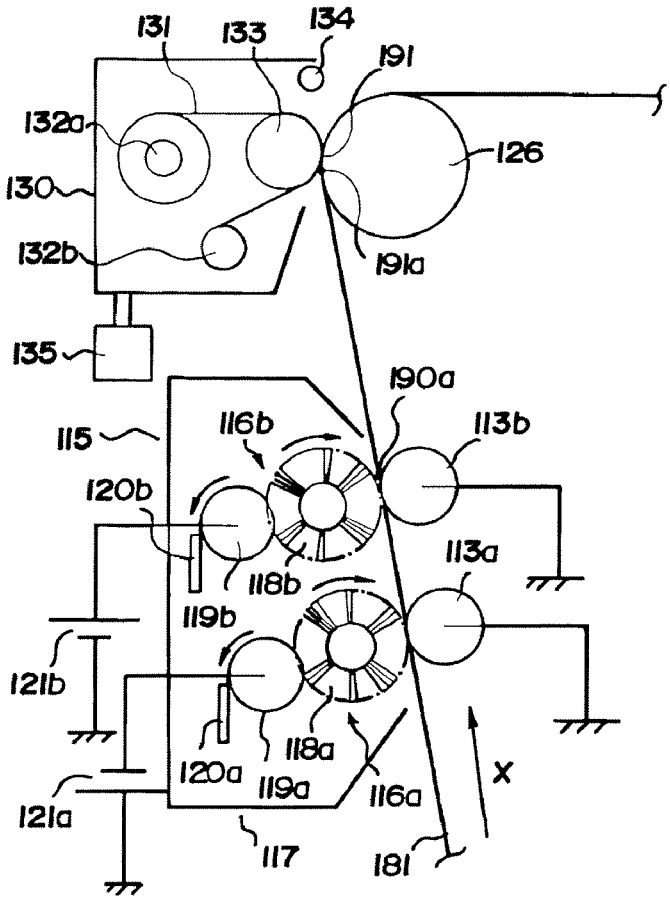
FIG. 3A and FIG. 3B are views illustrating an intermediate-transfer-member cleaning.

As illustrated in FIG. 3A, a device housing 117 is placed near the intermediate transfer belt 181. The first cleaning device 115 is structured to include an upstream-side cleaning portion 116*a* and a downstream-side cleaning portion 116*b* provided along the direction of the rotation of the intermediate transfer belt, within the aforementioned device housing 117. The upstream-side cleaning portion 116*a* and the downstream-side cleaning portion 116*b* include electrostatic cleaning members 118*a* and 118*b* with electric conductivity, metal rollers 119*a* and 119*b*, and cleaning blades 120*a* and 120*b*. Further, there are provided electrode rollers 113*a* and 113*b* which are grounded and contacted with the intermediate transfer belt 181 while being driven to be rotated thereby, at positions faced to the electrostatic cleaning members 118*a* and 118*b* across the intermediate transfer belt 181.

The electrostatic cleaning members 118*a* and 118*b* are formed from carbon-dispersed nylon fibers implanted on the metal rollers with an implanting density of 500,000/inch$^2$, wherein the carbon-dispersed nylon fibers have a resistance of 10 MΩ and a fiber thickness of 6 deniers. The metal rollers 119*a* and 119*b* are formed from electrically-conductive metal rollers made of aluminum which have been subjected at their surfaces to hard alumilite treatment, and the cleaning blades 120*a* and 120*b* are configured to be in contact with these metal rollers 119*a* and 119*b*.

The electrostatic cleaning members 118*a* and 118*b* are placed to slidably contact with the intermediate transfer belt 181 while being intruded to the intermediate transfer belt 181 by about 1.0 mm. Further, the electrostatic cleaning members 118*a* and 118*b* are configured to be rotated by a driven motor, not illustrated, in the direction of arrows in FIG. 3A, at a speed of 50 mm/sec.

The metal rollers 119*a* and 119*b* are placed to be kept intruded to the electrostatic cleaning members 118*a* and 118*b* by about 1.0 mm and also are placed to be rotated in the direction of the arrows in FIG. 3A at a speed equivalent to that of the electrostatic cleaning members 118*a* and 118*b*. The cleaning blades 120*a* and 120*b* which are in contact with the metal rollers 119*a* and 119*b* are made of a polyurethane rubber and are placed to be kept intruded to the metal rollers by 1.0 mm.

Further, a direct current constant voltage of −700 V (relative to the ground, the same will apply hereinafter) from a direct-current power supply 121*a* is applied to the metal roller 119*a* in the upstream-side cleaning portion 116*a* positioned at the upstream side in the direction of the rotation of the intermediate transfer belt. Further, a direct-current voltage of −700V, which is controlled to be a constant voltage, is applied to the electrostatic cleaning member 118*a* through the metal roller 119*a* from the direct-current power supply 121*a*. At this time, the direct-current power supply 121*a* controls the bias applied to the electrostatic cleaning member 118*a* to a constant voltage. On the other hand, a direct-current constant voltage of +700 V with the polarity opposite from that of the upstream-side cleaning portion 116*a*, from a direct-current power supply 121*b*, is applied to the metal roller 119*b* in the downstream side cleaning portion 116*b* positioned at the downstream side in the direction of the rotation of the intermediate transfer belt. Further, a direct-current voltage of +700 V, which is controlled to be a constant voltage, from the direct-current power supply 121*b*, is applied to the electrostatic cleaning member 118*b* through the metal roller 119*b*. At this time, the direct-current power supply 121*b* controls the bias applied to the electrostatic cleaning member 118*b* to a constant voltage.

As described above, the respective voltages from the power supplies 121*a* and 121*b* are applied to the metal rollers 119*a* and 119*b*. This causes an electric potential difference between the electrostatic cleaning members 118*a* and 118*b*, which causes (+) toner in the transfer residual toner on the intermediate transfer belt 181 to be adsorbed to and transferred to the electrostatic cleaning member 118*a*. The adsorbed and removed toner is transferred from the electrostatic cleaning member 118*a* to the metal roller 119*a* due to the electric potential difference and is swept away by the cleaning blade 120*a*.

Although the upstream-side cleaning portion 116*a* cleans off the transfer residual toner on the intermediate transfer belt 181, there is still left toner having no polarity or having the negative polarity on the intermediate transfer belt 181. Such toner is electrified to have the negative polarity, with the (−) bias applied to the electrostatic cleaning member 118*a* in the upstream-side cleaning portion 116*a*. It is deemed that the electrification is caused by injection of electric charge or by discharge.

Further, such toner can be removed by applying a (+) bias voltage to the downstream-side cleaning portion 116*b* placed downstream side of the upstream-side cleaning portion 116*a* for performing cleaning. Further, the removed toner is transferred from the electrostatic cleaning member 118*b* to the metal rollers 119*b* due to the electric potential difference and then is swept away by the cleaning blade 120*b*, so that all the transfer residual toner on the intermediate transfer belt 181 can be removed.

As described above, the first cleaning device 115 is configured to realize a cleaning system using the electrostatic cleaning members 118, which can reduce the burden on the intermediate transfer belt 181 and thus is advantageous, in particular, for cleaning the elastic intermediate transfer belt.

(Second Cleaning Device)

As illustrated in FIG. 3A, the second cleaning device 130 brings the contact-type cleaning member (the second removing member) 131 into contact with the intermediate transfer belt 181 and causes it to slide against the intermediate transfer belt 181 for cleaning it. In the present embodiment, the contact-type cleaning member 131 is wound around a supply roll 132*a* and a wind-up roll 132*b* and also is brought into contact with the intermediate transfer belt 181 at a predetermined pressure through a contacting roll 133. In the present embodiment, the contact-type cleaning member 131 is brought into contact with the intermediate transfer belt 181 at a total pressure of 2.0 kg.

The contact-type cleaning member 131 may be made of one or more types of materials selected out of nonwoven fabric, polyester, acrylic, vinylon, water soluble vinylon, rayon, nylon, polypropylene, cotton and the like. However, it is not limited to the aforementioned materials.

At portions where the intermediate transfer belt 181 is pressurized, such as the transfer portions, addition agents liberated from toner are rubbed on and adhered to the surface of the intermediate transfer belt 181. Such additional agents can not be collected by the first cleaning device 115 and, therefore, are mechanically collected by the contact-type cleaning member 131.

However, if the same surface of the contact-type cleaning member 131 is used for a long time, the amount of adherents that can be collected by the contact-type cleaning member 131 will be exceeded, which may cause adherents to be contrarily adhered to the surface of the intermediate transfer belt 181. This may change the electrical resistance of the intermediate transfer belt 181, thus resulting in image failures and the like. Accordingly, the contact-type cleaning member 131 is wound up around the windup roll 132*b* by a certain amount, after the elapse of a certain time period, to provide a new surface to be brought into contact with the intermediate transfer belt 181.

In the present embodiment, the timing and the amount at and by which the contact-type cleaning member 131 is wound up are such that the contact-type cleaning member 131 is wound up by 5 mm every time one hundred A4 sheets have been printed. This enables successfully removing adherents adhered to the surface of the intermediate transfer belt 181.

While, in the present embodiment, there has been exemplified the second cleaning device 130 employing a web, the second cleaning device 130 may have any configuration having the function of capturing, into its inside, adherents on the surface of the intermediate transfer belt by contacting with the intermediate transfer belt 181. For example, the second cleaning device 130 may have a configuration which brings a roller including an non-woven cloth wound around its surface into contact with the intermediate transfer belt 181 and drives and rotates the roller.

Figure 3B:
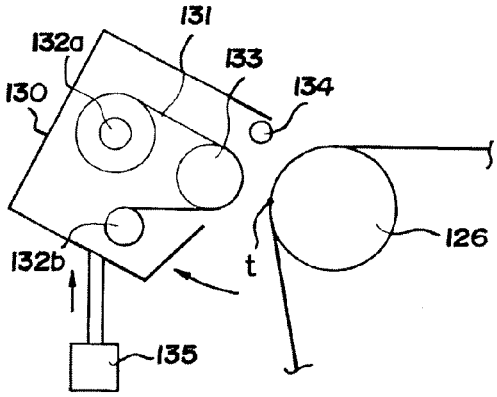

Further, as shown in FIG. 3B the second cleaning device 130 is supported rotatably about a rotation shaft 134, and the contact-type cleaning member 131 is made contactable with and removable from the intermediate transfer belt 181 through a pressurization/release means 135 constituted by a solenoid or the like. When the pressurization/release means 135 is off, the contact-type cleaning member 131 is kept in contact with the intermediate transfer belt 181. On the other hand, if the pressurization/release means 135 is turned on, this will cause the second cleaning device 130 to rotate about the rotation shaft 134, thereby causing the contact-type cleaning member 131 to be released from the intermediate transfer belt 181.

(Control for Removing the Second Cleaning Device)

The image forming apparatus according to the present embodiment is configured such that the contact-type cleaning member 131 in the aforementioned second cleaning device 130 is released from the intermediate transfer belt 181, at the time of interruption of the application of the bias to the first cleaning device. This is for preventing an excessive amount of toner from being adhered to the contact-type cleaning member 131. Next, there will be described the configuration for controlling the release of the contact-type cleaning member 131.

In the image forming apparatus according to the present embodiment, the contact portion where the downstream-side electrostatic cleaning member 118*b* in the first cleaning device 115 is contacted with the intermediate transfer belt 181 (hereinafter, referred to as "a first contact portion") has a width of 8 mm. Further, the contact portion where the contact-type cleaning member 131 in the second cleaning device 130 is contacted with the intermediate transfer belt 181 (hereinafter, referred to as "a second contact portion") has a width of 4 mm. Further, in the direction of the rotation of the intermediate transfer belt 181, the distance between the center of the contact region of the aforementioned first contact portion and the center of the contact region of the second contact portion is set to 50 mm. Further, the processing speed of the image forming apparatus according to the present embodiment, namely the peripheral speed of the rotation of the intermediate transfer belt 181, is set to 300 mm/sec.

In this case, when the application of the biases to the first cleaning device 115, namely the electrostatic cleaning members 118, are interrupted at the end of a job, the toner which has been constrained to the electrostatic cleaning members 118*a* and 118*b* loses the electrostatic constraint force. Consequently, the toner may be adhered to the intermediate transfer belt 181, again.

On the other hand, in the image forming apparatus according to the present embodiment, the time interval from the starting of interruption of the application of the biases to the first cleaning device 115 to the completion of the interruption of the biases (hereinafter, referred to as "a bias-off time interval") is 100 msec.

In this case, the time of the interruption of the application of the biases to the first cleaning device 115, namely the electrostatic cleaning members 118*a* and 118*b*, refers to the time as follows. Namely, in the case where the biases applied to the electrostatic cleaning members 118*a* and 118*b* are controlled to predetermined constant voltages, the aforementioned time refers to the time when the biases start changing from the predetermined voltages toward 0 V.

Figure 4A:
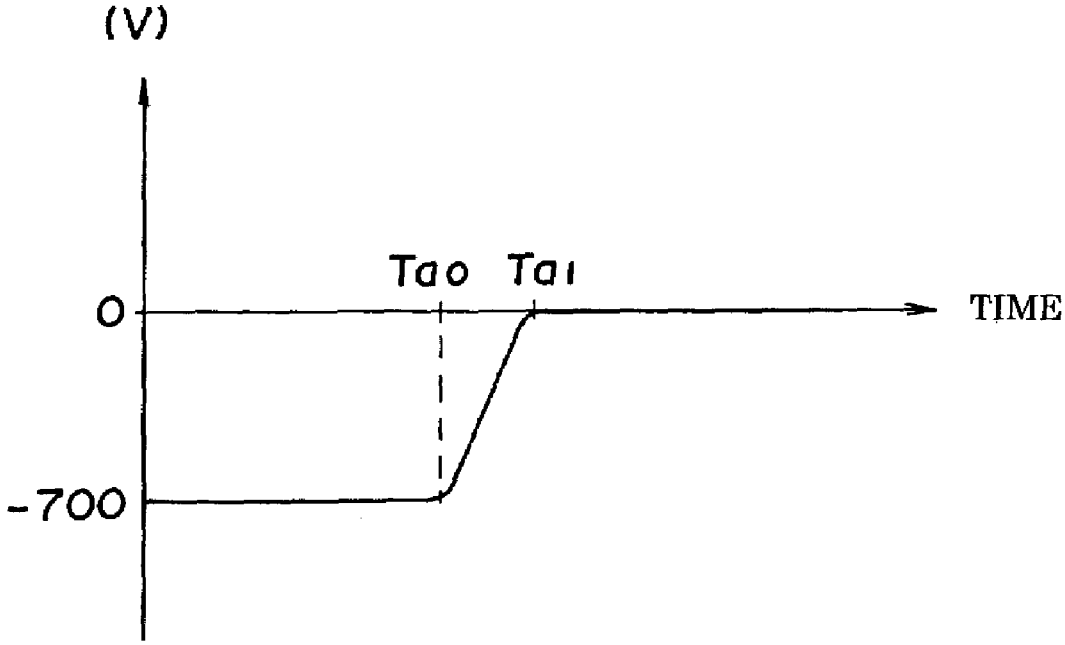
FIGS. 4A and 4B are views illustrating the changes of bias voltages applied to electrostatic cleaning members, when the biases are interrupted.

Namely, in the present example, the bias applied to the electrostatic cleaning member 118*a* is controlled to a constant voltage of −700 V, by the direct-current power supply 121*a*. As illustrated in FIG. 4A, when the direct-current power supply 121*a* is turned off, the bias applied to the electrostatic cleaning member 118*a* is gradually changed from −700 V to 0 V for 100 msec. In this case, the time of the interruption of the application of the bias to the electrostatic cleaning member 118*a* refers to the moment when the bias starts changing from −700 V toward 0 V (time Ta0). In this case, time Ta1 refers to the time when the bias reaches 0 V.

Figure 4B:
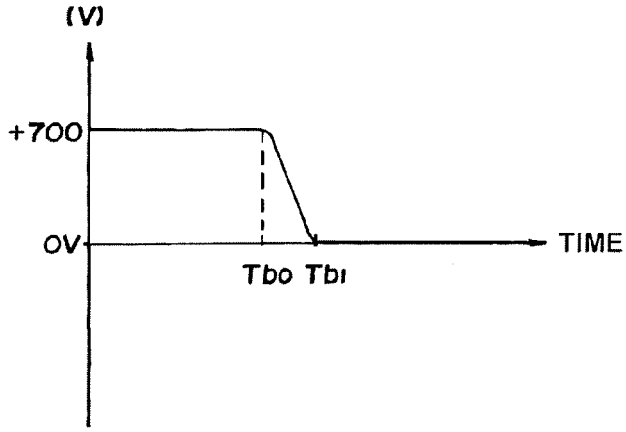
Figure 5:
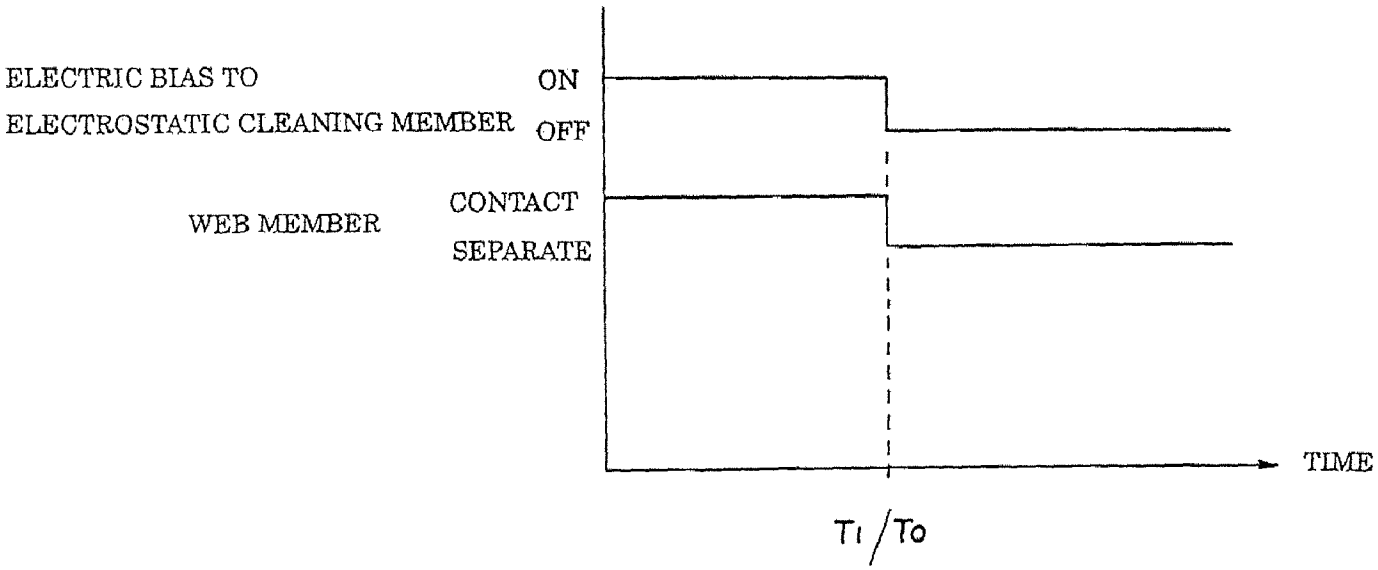
FIG. 5 is a timing chart illustrating the timing T1 of interruption of the biases applied to a first cleaning means and the timing To of releasing a second cleaning means, according to a first example.
Figure 6:
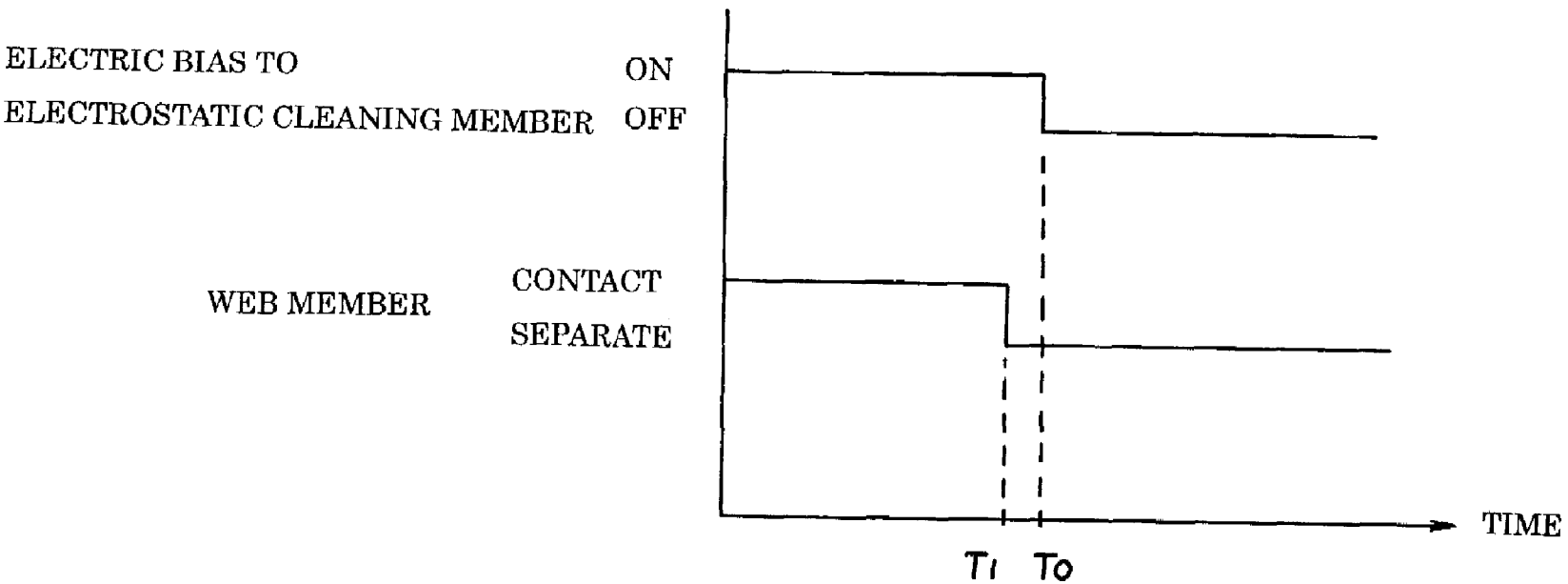
FIG. 6 is a timing chart illustrating the timing T1 of interruption of the biases applied to a first cleaning means and the timing To of releasing a second cleaning means, according to a second example.

The same applies to the electrostatic cleaning member 118*b*, to which a bias controlled to a constant current of +700 V is applied. Namely, as illustrated in FIG. 4B, the moment when the bias starts changing from +700 V towards 0 V (time Tb0) since the direct-current power supply 121*b* is turned off is defined as the time of the interruption of the application of the bias to the electrostatic cleaning member 118*b*. In this case, time Tb1 refers to the time when the bias reaches 0 V.

The time of the interruption of the application of the biases to the first cleaning means 115, namely the electrostatic cleaning members 118*a* and 118*b* is defined as described above for the following reason. That is, when the direct-current power supplies 121*a* and 121*b* are turned off, the ratio of change of the biases applied to the electrostatic cleaning members 118*a* and 118*b* (the change of the biases per unit time) becomes largest at the time when the biases start changing from the predetermined electric potentials toward 0 V. Accordingly, the amount of toner that is released from the electrostatic cleaning members 118*a* and 118*b* and is re-adhered to the intermediate transfer belt 181 becomes greatest at the time when the biases start changing from the predetermined electric potentials toward 0 V.

In the present embodiment, the processing speed (the speed of the travel of the intermediate transfer belt 181) is 300 mm/sec. Therefore, even if the biases applied to the first cleaning means 115 are interrupted concurrently with the completion of a job, toner will be re-adhered to the intermediate transfer belt 181 and will be moved by at least 30 mm in the downstream direction, during the bias-off time interval. Further, even if the driving motor for the intermediate transfer belt 181 is turned off concurrently therewith, the intermediate transfer belt 181 will be moved by about 30 mm, due to the inertia. Accordingly, the toner re-adhered to the intermediate transfer belt 181 will be moved by a total of at least 60 mm, in the downward direction.

In this case, the smallest distance between the first contact portion 190 and the second contact portion 191 is the distance between the most downstream position 190*a* of the contact region with a width of 8 mm of the first contact portion 190 (downstream from the center of the contact region by 4 mm) and the most upstream position 191*a* of the contact region with a width of 4 mm of the second contact portion 191 (upstream from the center of the contact region by 2 mm). Namely, in the image forming apparatus according to the present embodiment, the aforementioned smallest distance is 44 mm.

Accordingly, if the toner t re-adhered to the intermediate transfer belt 181 is moved by 60 mm downwardly from the most downstream position 190*a* of the contact region of the first contact portion 190, the toner t will intrude into the most upstream position 191*a* of the contact region of the second contact portion 191. Namely, if the contact-type cleaning member 131 in the second cleaning device 130 is kept in contact with the intermediate transfer belt 181, the toner t re-adhered to the intermediate transfer belt 181 will be captured by the contact-type cleaning member 131.

Therefore, the image forming apparatus according to the present embodiment is configured such that the pressurization/release means 135 is turned on to release the contact-type cleaning member 131 in the second cleaning device 130 from the intermediate transfer belt 181, concurrently with the interruption of the application of the biases to the first cleaning member 115.

Accordingly, in the image forming apparatus according to the present embodiment, the timing of the interruption of the biases applied to the electrostatic cleaning members 118*a* and 118*b* and the timing of the release of the contact-type cleaning member 131 from the intermediate transfer belt 181 are set as follows. Namely, before the toner released from the electrostatic cleaning members 118*a* and 118*b* and re-adhered to the intermediate transfer belt 181, due to the interruption of the application of the biases, reaches the contact-type cleaning member 131, the contact-type cleaning member 131 is released from the intermediate transfer belt 181. Namely, the contact-type cleaning member 131 is released from the intermediate transfer belt 181, in such a manner as to prevent the region of the intermediate transfer belt 181 which is contacted with the electrostatic cleaning members 118*a* and 118*b* at the time of the interruption of the application of the biases to the electrostatic cleaning members 118*a* and 118*b* from coming into contact with the contact-type cleaning member 131.

This can prevent the toner and the like which is re-adhered to the intermediate transfer belt 181 at the time of the interruption of the biases applied to the electrostatic cleaning members 118*a* and 118*b* from being adhered to the contact-type cleaning member 131. This can prevent an excessive amount of toner from being deposited on the contact-type cleaning member 131 and can prevent toner from being rubbed on the intermediate transfer belt.

Further, even in cases where the biases applied to the first cleaning device 115 are controlled to constant electric currents, the same effects can be provided by interrupting the application of the biases to the first cleaning device and releasing the second cleaning device in the aforementioned manner. In this case, biases which are controlled to constant electric currents of −15 μA and +15 μA are applied to the electrostatic cleaning members 118*a* and 118*b*. The power supplies 121*a* and 121*b* control the respective biases to constant electric currents.

In the case where the biases applied to the first cleaning means are controlled to predetermined constant electric current values, the time of the interruption of the application of the biases to the first cleaning device 115 refers to the time when the biases start changing from the predetermined electric current values toward 0 μA.

Namely, in the present example, the bias applied to the electrostatic cleaning member 118*a* is controlled to a constant electric current of −15 μA, through the direct-current power supply 121*a*. If the direct-current power supply 121*a* is turned off, the bias applied to the electrostatic cleaning member 118*a* is gradually changed from −15 μA to 0 μA for 100 msec. In this case, the time of the interruption of the application of the bias to the electrostatic cleaning member 118*a* refers to the moment when the bias starts changing from −15 μA to 0 μA.

The same applies to the electrostatic cleaning member 118*b*, to which a bias controlled to a constant electric current of +15 μA is applied.

Namely, the moment when the bias starts changing from +15 μA toward 0 μA since the direct-current power supply 121*b* is turned off is defined as the time of interruption of the application of the bias to the electrostatic cleaning member 118*b*.

Second Embodiment

In the aforementioned embodiment, the contact-type cleaning member 131 is released from the intermediate transfer belt 181 concurrently with the interruption of the application of the biases to the electrostatic cleaning members 118*a* and 118*b*. However, the contact-type cleaning member 131 may be released from the intermediate transfer belt 181, before the interruption of the application of the biases to the electrostatic cleaning members 118*a* and 118*b* (100 msec in advance of the interruption of the application of the biases, in the present embodiment).

In this case, similarly to the aforementioned first embodiment, the contact-type cleaning member 131 is released from the intermediate transfer belt 181, before the toner and the like released from the electrostatic cleaning members 118*a* and 118*b* and re-adhered to the intermediate transfer belt 181 at the time of the interruption of the biases reaches the contact-type cleaning member 131. This can provide effects similar to those of the first embodiment.

In the present example, similarly, the biases applied to the electrostatic cleaning members 118*a* and 118*b* can be controlled to predetermined constant voltages or predetermined constant electric currents.

Third Embodiment

In the present embodiment, the contact-type cleaning member 131 is released from the intermediate transfer belt 181, after the interruption of the application of the biases to the electrostatic cleaning members 118*a* and 118*b* (after 100 msec following the interruption of the application of the biases, in the present embodiment). As described above, the smallest distance between the first contact portion 190 and the second contact portion 191 is the distance between the most downstream position 190*a* of the contact region with a width of 8 mm of the first contact portion 190 (downstream from the center of the contact region by 4 mm) and the most upstream position of the contact region with a width of 4 mm of the second contact portion 191 (upstream from the center of the contact region by 2 mm). Namely, in the image forming apparatus according to the present embodiment, the aforementioned smallest distance is 44 mm.

In the image forming apparatus according to the present example, the speed of the travel of the intermediate transfer belt 181 is 300 mm/sec.

Therefore, the intermediate transfer belt 181 requires a time period of 146 msec to travel from the most downstream position 190*a* of the contact region of the first contact portion 190 to the most upstream position 191*a* of the contact region of the second contact portion 191.

Accordingly, the second cleaning device 130 is released from the intermediate transfer belt 181, before the toner adhered to the intermediate transfer belt 181 due to the interruption of the application of the biases to the electrostatic cleaning members 118*a* and 118*b* reaches the second cleaning device 130.

In the present example, similarly, the biases applied to the electrostatic cleaning members 118*a* and 118*b* can be controlled to predetermined constant voltages or predetermined constant electric currents.

As described in the aforementioned first to third embodiments, when the region of the intermediate transfer belt 181 which is contacted with the first cleaning device 115 at the time of the interruption of the application of the biases to the first cleaning device 115 reaches the second contact portion, the second cleaning device is released from the intermediate transfer belt 181.

This can prevent the second cleaning means 130 from rubbing the toner which has been adhered to the intermediate transfer belt 181, due to the interruption of the application of the biases to the first cleaning means 115, on the intermediate transfer belt 181.

In the aforementioned embodiments, there has been exemplified the first cleaning device 115 employing the two electrostatic cleaning members 118*a* and 118*b*. However, in the first to third embodiments, the first cleaning means may be configured to include only a single electrostatic cleaning member For example, in cases of an image forming apparatus for forming toner images with the negative polarity, most of secondary-transfer residual toner has the positive polarity and, therefore, a bias with the negative polarity may be applied to a single electrostatic cleaning member to remove the toner on the intermediate transfer belt.

CROSS-REFERENCE TO RELATED APPLICATION

This application claims the benefit of priority from the prior Japanese Patent Application No. 2005-262542 filed on Sep. 9, 2005 the entire contents of which are incorporated by reference herein.

What is claimed is:

1. An image forming apparatus comprising:

an image bearing member which bears developing-agent images;

a first removing member which removes a developing agent from said image bearing member, wherein said first removing member is contacted with said image bearing member while a bias is applied to said first removing member;

a second removing member which removes the developing agent from said image bearing member, wherein said second removing member is contacted with a region of said image bearing member from which said developing agent has been removed by said first removing member; and means which separates said second removing member from said image bearing member in such a manner as to prevent the region of said image bearing member which is contacted with said first removing member at the time of interruption of the application of the bias to said first removing member from coming into contact with said second removing member.

2. The image forming apparatus according to claim 1, wherein said second removing member is contacted with said image bearing member at a time of interruption of the application of the bias to said first removing member.

3. The image forming apparatus according to claim 2, wherein said first removing member is a brush.

4. The image forming apparatus according to claim 3, wherein the second removing member is a web.

* * * * *

UNITED STATES PATENT AND TRADEMARK OFFICE

CERTIFICATE OF CORRECTION

PATENT NO. : 7,379,686 B2
APPLICATION NO. : 11/466888
DATED : May 27, 2008
INVENTOR(S) : Akihiro Nishikawa It is certified that error appears in the above-identified patent and that said Letters Patent is hereby corrected as shown below:

COLUMN 1
Line 31, “provided” should read --provided on the--.

Figure 7:
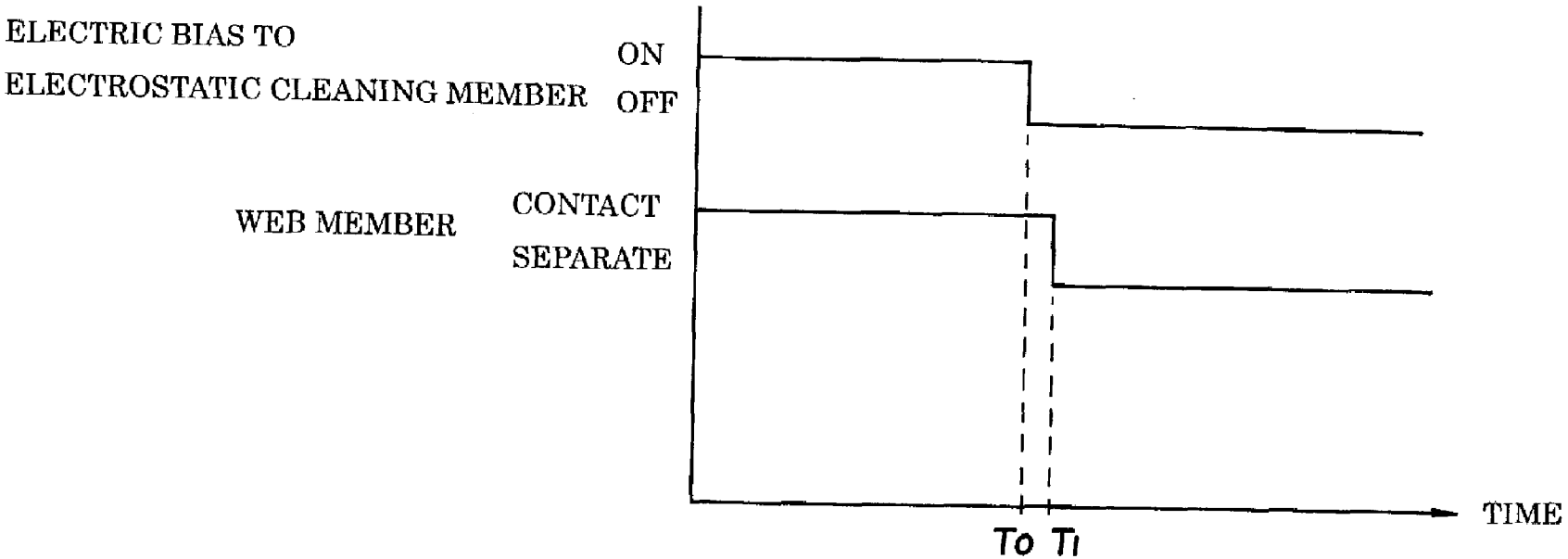
FIG. 7 is a timing chart illustrating the timing T1 of interruption of the biases applied to a first cleaning means and the timing To of releasing a second cleaning means, according to a third example.

COLUMN 2
Line 28, “example. FIG. 7” should read --example. ¶FIG. 7--.
Line 65, “cyan (C),” should read --cyan (C) and--.

COLUMN 3
Line 11, “that the color” should read --but the colors--.
Line 12, “formed.” should read --formed by them are different from each other.--.

COLUMN 4
Line 40, “placed” should read --placed on the--.
Line 42, “but” should read --but on the--.
Line 60, “placed” should read --placed on the--.

COLUMN 6
Line 67, “placed” should read --placed on the--.

COLUMN 7
Line 29, “nonwoven” should read --non-woven--.
Line 67, “an” should read --a--.

COLUMN 12
Line 18, “member” should read --member.--.

Signed and Sealed this

Eighteenth Day of November, 2008

JON W. DUDAS
*Director of the United States Patent and Trademark Office*